US011016417B2

(12) United States Patent
Sakamaki

(10) Patent No.: US 11,016,417 B2
(45) Date of Patent: May 25, 2021

(54) DEVELOPING APPARATUS

(71) Applicant: CANON KABUSHIKI KAISHA, Tokyo (JP)

(72) Inventor: Tomoyuki Sakamaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/699,827

(22) Filed: Dec. 2, 2019

(65) Prior Publication Data

US 2020/0192246 A1 Jun. 18, 2020

(30) Foreign Application Priority Data

Dec. 12, 2018 (JP) ..... JP2018-232719

(51) Int. Cl.
*G03G 15/08* (2006.01)

(52) U.S. Cl.
CPC ..... *G03G 15/0891* (2013.01)

(58) Field of Classification Search
CPC ..... G03G 15/0887; G03G 15/0891
See application file for complete search history.

(56) References Cited

U.S. PATENT DOCUMENTS 5,430,532 A * 7/1995 Ueda ..... G03G 15/08 399/263
5,440,376 A * 8/1995 Hagihara ..... G03G 15/0844 399/120
7,346,286 B2 * 3/2008 Matsumoto ..... G03B 15/08 399/259
8,086,145 B2 * 12/2011 Ozawa ..... G03G 15/0844 399/257
8,355,655 B2 1/2013 Sakamaki
8,532,538 B2 * 9/2013 Inoue ..... G03G 15/0877 399/255
9,329,523 B2 5/2016 Sakamaki
9,436,130 B2 9/2016 Sakamaki
(Continued)

FOREIGN PATENT DOCUMENTS

JP S59-100471 A 6/1984
JP H11-219013 A 8/1999
(Continued)

*Primary Examiner* — Walter L Lindsay, Jr.
*Assistant Examiner* — Milton Gonzalez
(74) *Attorney, Agent, or Firm* — Venable LLP

(57) ABSTRACT

A developing apparatus includes a developer container to accommodate a developer including toner and carrier, and a conveyance screw having a helical blade spirally formed on a rotation shaft to convey the developer. The developer container has a developer discharge port at a position facing the helical blade to discharge the developer from the developer container, wherein the helical blade rotates to direct from below to above in a vertical direction at a position facing the developer discharge port. The developer discharge port has a lower edge in the vertical direction, with the lower edge having a region downstream in a developer conveyance direction from a lowermost position in the lower edge in the vertical direction, and the region in a position above the lowermost position in the vertical direction, wherein the region inclines upward as the lower edge goes downstream in the developer conveyance direction.

9 Claims, 16 Drawing Sheets

(56) References Cited

U.S. PATENT DOCUMENTS

| | | | | |
|---|---|---|---|---|
| 9,983,511 | B2 | 5/2018 | Sakamaki | |
| 2008/0199223 | A1* | 8/2008 | Tateyama | G03G 15/0822 399/254 |
| 2016/0062275 | A1 | 3/2016 | Sakamaki | |
| 2016/0085181 | A1* | 3/2016 | Sakamaki | G03G 15/0891 399/257 |

FOREIGN PATENT DOCUMENTS

| | | | | |
|---|---|---|---|---|
| JP | 2000-112238 | A | | 4/2000 |
| JP | 2016-065916 | A | | 4/2016 |
| JP | 2016-186622 | A | | 10/2016 |
| JP | 2017156588 | A | * | 9/2017 |

* cited by examiner

DEVELOPING APPARATUS

BACKGROUND OF THE INVENTION

Field of the Invention

The present disclosure relates to a developing apparatus that develops an electrostatic latent image formed on an image bearing member by an electrophotographic system, an electrostatic recording system, or the like to form a visible image.

Description of the Related Art

Hitherto, in an image forming apparatus which employs an electrophotographic system or an electrostatic recording system, an electrostatic latent image formed on an image bearing member such as a photosensitive drum is developed by a developing apparatus. As such a developing apparatus, in order to suppress deterioration of charging performance of a developer, a configuration in which the developer is replenished by a replenishing device, and an excessive developer in a developer container that has become excessive due to the replenishment is discharged by a developer discharge port provided on a wall surface of the container has been proposed (JP-A-S59-100471). By this, the developer is gradually replaced, and the deterioration of the developer can be suppressed.

However, in the case of such a configuration that the developer discharge port is provided, there is a possibility that the developer which is not excessive is also discharged. That is, in the developing apparatus, the developer is conveyed by a screw (a conveyance member) provided with a blade on a rotation shaft, and, in this case, there is a possibility that the developer is jumped up by the blade and the developer which is not excessive is discharged from the developer discharge port.

Thus, a developing apparatus having a configuration in which a force in a circumferential direction or a force in an outward radial direction acting on the developer by a rotation of the screw in an area facing the developer discharge port is smaller than that in the other area has been proposed (JP-A-2000-112238). Specifically, there are disclosed a configuration in which the blade of the screw in a region facing the developer discharge port is downsized, and a configuration in which the blade in this region is omitted. However, in a case where the blade of the screw in the region facing the developer discharge port is downsized or omitted, there is a problem as below. With this configuration, the screw conveyance capability in the region facing the developer discharge port is reduced as compared with upstream and downstream regions of the developer discharge port in a developer conveyance direction. As a result, there is a possibility that the developer in the region facing the developer discharge port becomes stagnant, the developer surface becomes unstable, and unstable discharge is repeated, thereby desired discharge characteristics may not be obtained.

On the other hand, there also has been proposed a configuration in which even when an amount of the developer to be replenished suddenly increases, a lower end of the developer discharge port is formed so as to become higher as it goes upstream in the developer conveyance direction, in order to rapidly stabilize the amount of the developer in the container (JP-A-H11-219013). In this configuration, the developer discharge port is disposed at a position facing a part where the blade of the screw rotates to direct from below to above, and the lower end of the developer discharge port is formed so as to become higher as it goes upstream in the developer conveyance direction. In this configuration, the position of the lower end of the developer discharge port does not change even if it goes downstream in the developer conveyance direction, and the lower end of the developer discharge port is formed so as to be orthogonal at the downstream end portion and to be continuous with an upper end of the developer discharge port. In other words, a side edge on the downstream side in the developer conveyance direction of the developer discharge port is not inclined. Therefore, in this configuration, since the lower end of the developer discharge port is formed so as to be lower as it goes downstream in the developer conveyance direction, the developer can be rapidly discharged even in a case where a large amount of new developer is supplied into the developer container.

However, it is difficult to suppress the discharge of the developer due to jumping-up of the developer due to the blade in the configuration disclosed in JP-A-H11-219013. That is due to the following reasons. In the configuration of JP-A-H11-219013, since the developer discharge port is disposed at a position facing a part where the blade of the screw rotates to direct from below to above, the developer located below the screw is directly jumped up toward the developer discharge port by the blade of the screw. Thus, when the amount of developer is large, the developer is discharged from the developer discharge port, and the developer surface near the developer discharge port is lowered as it goes downstream in the developer conveyance direction. Even if the developer surface is lowered as it goes downstream in the developer conveyance direction, in the configuration of JP-A-H11-219013, since the lower end of the developer discharge port is lowered as it goes downstream in the developer conveyance direction, a state where the developer is likely to be easily discharged continues. Therefore, even when the developer surface is low and the developer is not required to be discharged, there is a concern that the developer is discharged.

In consideration of the circumstances, an object of the disclosure is to provide a developing apparatus capable of sufficiently suppressing the discharge of the developer due to jumping-up in a configuration where a developer discharge port is disposed at a position facing a part where a blade of a screw rotates to direct from below to above.

SUMMARY OF THE INVENTION

According to a first aspect of the present invention, a developing apparatus includes a developer container configured to accommodate a developer, and a conveyance member comprising a blade spirally formed on a rotation shaft and configured to rotate to convey the developer inside the developer container along the rotation shaft, wherein the developer container has a developer discharge port at a position facing the blade to discharge an excessive developer accompanying a replenishment of the developer from the developer container, wherein the blade rotates to direct from below to above in a vertical direction in an installation state in a facing part to the developer discharge port, and wherein the developer discharge port comprises a lower edge in the vertical direction comprising a first part positioned at a lowermost position in the vertical direction and a second part positioned downstream of the first part in a developer conveyance direction and positioned above the first part in the vertical direction.

According to a second aspect of the present invention, a developing apparatus includes a developer container configured to accommodate a developer, and a conveyance member comprising a blade spirally formed on a rotation shaft and configured to rotate to convey the developer inside the developer container along the rotation shaft, wherein the developer container has a developer discharge port at a position facing the blade to discharge an excessive developer accompanying a replenishment of the developer from the developer container, wherein the blade rotates to direct from below to above in a vertical direction in an installation state in a facing part to the developer discharge port, wherein the developer discharge port comprises an upper edge in the vertical direction and an upstream edge extending downward in the vertical direction from an upstream end of the upper edge in the developer conveyance direction, and wherein when a triangle formed by the upper edge, the upstream end portion, and a diagonal line connecting a downstream end portion of the upper edge in the developer conveyance direction to a lower end of the upstream edge in the vertical direction is defined as a reference triangle, the developer discharge port is formed such that an area of a part included inside the reference triangle is larger than an area of a part not included inside the reference triangle.

Further features of the present invention will become apparent from the following description of exemplary embodiments with reference to the attached drawings.

DESCRIPTION OF THE EMBODIMENTS

First Embodiment

Figure 1:
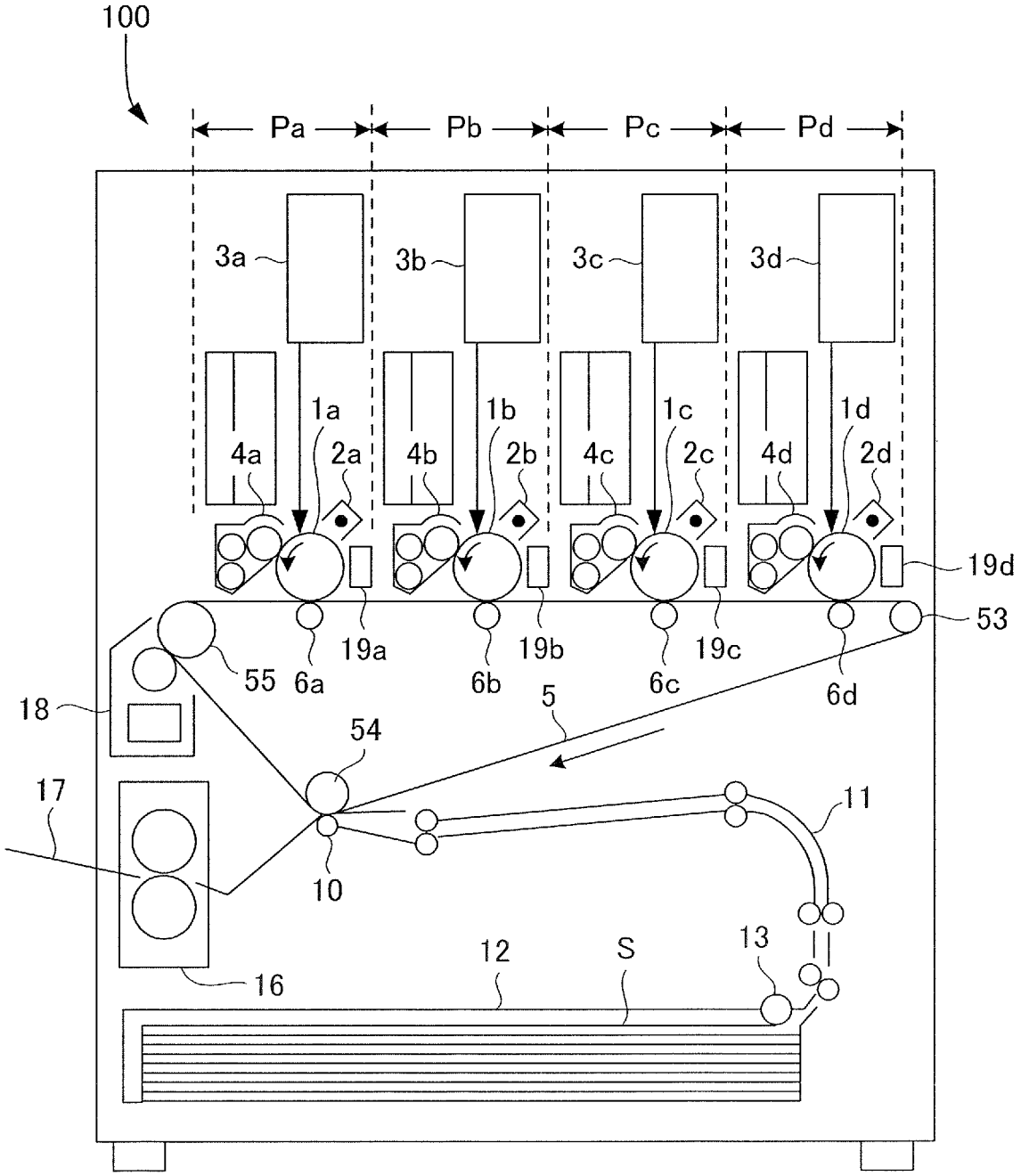
FIG. 1 is a sectional view of an outline configuration of an image forming apparatus according to a first embodiment.

A first embodiment of the disclosure will be described with reference to FIGS. 1 to 11B. First, an outline configuration of an image forming apparatus 100 of the embodiment will be described with reference to FIG. 1. In the embodiment, a tandem type full-color printer is described as an example of the image forming apparatus 100. However, the disclosure is not limited to being mounted on the tandem type image forming apparatus 100, and may be mounted on an image forming apparatus of another type. Also, the disclosure is not limited to full color, and may be monochrome or mono color. Alternatively, the disclosure can be implemented for various uses such as a printer, various printing machines, a copying machine, a FAX, and a multifunction machine.

Image Forming Apparatus

The image forming apparatus 100 of the embodiment is a full-color image forming apparatus 100 that employs an electrophotographic system, and includes four image forming units P (Pa, Pb, Pc, and Pd). The configuration of each image forming unit P is substantially the same except that development colors are different. Therefore, hereinafter, when particular distinction is not required, subscripts a, b, c, and d given to the reference numerals of P, 1 to 4, 6, and 19 described later will be omitted and will be described comprehensively, in order to indicate that it is an element belonging to any of the image forming unit P.

Each image forming unit P includes a drum-shaped electrophotographic photosensitive member that rotates in a direction of an arrow (counterclockwise direction) as an image bearing member that carries a toner image, that is, a photosensitive drum 1. In addition, around the periphery, an image forming mechanism including a charger 2, a laser beam scanner 3 as an exposing portion, a developing apparatus 4, a transfer roller 6, a cleaning portion 19, and the like is provided.

Next, an image forming sequence in a normal mode of the entire image forming apparatus 100 having the above configuration will be described. First, the photosensitive drum 1 is uniformly charged by the charger 2. In the normal mode, the photosensitive drum 1 rotates in the counterclockwise direction indicated by an arrow at a process speed (peripheral speed) of, for example, 273 mm/sec. The uniformly charged photosensitive drum 1 is subjected to scanning exposure by the laser beam scanner 3 using laser light modulated by an image signal.

The laser beam scanner 3 incorporates a semiconductor laser, the semiconductor laser being controlled based on inputted image data, and emitting laser light. For example, the laser beam scanner is controlled according to a document image information signal (image data) input from a document reading apparatus having a photoelectric conversion element such as a CCD, or according to an image information signal input from an external terminal to emit laser light. As a result, a surface potential of the photosensitive drum 1 charged by the charger 2 changes in an image portion, and an electrostatic latent image is formed on the photosensitive drum 1. In the embodiment, the charger 2 and the laser beam scanner 3 constitute an electrostatic latent image forming unit.

The electrostatic latent image formed on the photosensitive drum 1 in this way is reversely developed with toner by the developing apparatus 4 to be a visible image, that is, a toner image. In the embodiment, the developing apparatus 4 uses a two-component developing system that uses a developer containing toner and carrier as a developer. That is, each developing apparatus 4*a*, 4*b*, 4*c*, and 4*d* accommodates a two-component developer including toner of each color. Specifically, yellow (Y) toner, magenta (M) toner, cyan (C) toner, and black (K) toner are respectively accommodated in the developing apparatus 4*a*, the developing apparatus 4*b*, the developing apparatus 4*c*, and the developing apparatus 4*d*. Therefore, by performing the above-described process for each of the image forming units Pa, Pb, Pc, and Pd, toner images of the four colors of yellow, magenta, cyan, and black are respectively formed on the photosensitive drums 1*a*, 1*b, c*, and 1*d*.

Further, an intermediate transfer belt 5 that is an intermediate transfer member is disposed below each image forming unit Pa, Pb, Pc, and Pd. The intermediate transfer belt 5 is suspended by rollers 53, 54, and 55 and is movable in the direction of the arrow. The toner image on the photosensitive drum 1 is sequentially transferred to the intermediate transfer belt 5 by the transfer roller 6 as a primary transfer portion. By this, toner images of four colors of yellow, magenta, cyan, and black are superimposed on the intermediate transfer belt 5 to form a full-color image. Further, the toner remaining on the photosensitive drum 1 without being transferred onto the intermediate transfer belt 5 is collected by the cleaning portion 19.

The full-color image on the intermediate transfer belt 5 is transferred to a recording material S such as a sheet (paper, OHP sheet, or the like) taken out from a feed cassette 12 and proceeded via a feed roller 13 and a feed guide 11 by an action of a secondary transfer roller 10. The toner remaining on the surface of the intermediate transfer belt 5 without being transferred to the recording material S is collected by an intermediate transfer belt cleaning portion 18. On the other hand, the recording material S to which the toner image is transferred is sent to a fixing device 16, and the image is fixed and discharged to a discharge tray 17.

In the embodiment, the photosensitive drum 1 which is usually an organic photosensitive member having a drum shape is used as an image bearing member, but an inorganic photosensitive member such as an amorphous silicon photosensitive member can also be used. Further, it is also possible to use a belt-like photosensitive member. A charging method, a transfer method, a cleaning method, and a fixing method are not limited to the above methods.

Developing Apparatus

Next, the developing apparatus 4 will be described with reference to FIGS. 2 and 3. The developing apparatus 4 includes a developer container 22 that accommodates a two-component developer, a developing sleeve 28 that is a developer bearing member, and first and second conveyance screws 25 and 26 that are conveyance members. Further, since the developing apparatus 4 of the embodiment is of a vertical stirring type, substantially central portion of an inside of the developer container 22 is vertically partitioned into a developing chamber 23 as a storage portion and an agitating chamber 24, by a partition wall 27 extending in an axial direction of the developing sleeve 28. The developer is accommodated in the developing chamber 23 and the agitating chamber 24.

The first and second conveyance screws 25 and 26 are arranged in the agitating chamber 24 and the developing chamber 23, respectively. The first conveyance screw 25 is disposed substantially parallel to a bottom of the developing chamber 23 on an upper side along the axial direction of the developing sleeve 28 and rotates counterclockwise as shown in FIG. 2 to convey the developer in the developing chamber 23 while agitating the developer in one direction along the rotation axis direction. In the embodiment, the conveyance direction of the developer in the developing chamber 23 is indicated as a developer conveyance direction D1. Further, the second conveyance screw 26 is disposed substantially in parallel with the first conveyance screw 25 at the bottom in the agitating chamber 24 on a lower side, and rotates in the clockwise direction as shown in FIG. 2 in the direction opposite to the first conveyance screw 25. The second conveyance screw 26 conveys the developer in the agitating chamber 24 while agitating the developer in the direction opposite to the first conveyance screw 25 along the rotation axis direction.

As described above, the developer is conveyed by the rotation of the first and second conveyance screws 25 and 26, such that the developer is circulated between the developing chamber 23 and the agitating chamber 24 through opening portions (that is, communicating portions) 11 and 12 (refer to FIG. 3) at both end portions of the partition wall 27. In the embodiment, the case where the disclosure is applied to the developing apparatus 4 in which the developing chamber 23 and the agitating chamber 24 are arranged vertically is described, but the disclosure is not limited thereto. For example, the disclosure can be applied to a developing apparatus used hitherto in which the developing chamber 23 and the agitating chamber 24 are arranged horizontally, or other types of developing apparatuses.

There is an opening portion at a position corresponding to the developing position of the developer container 22 facing the photosensitive drum 1, and the developing sleeve 28 is rotatably disposed in this opening portion so as to be partially exposed in the direction of the photosensitive drum 1. The developing sleeve 28 carries and conveys the developer accommodated in the developer container 22 and supplies the developer to the developing position of the photosensitive drum 1. The length (coat amount) of the developer bristle (magnetic brush) carried on the developing sleeve 28 is regulated by a regulating blade 29 that is a bristle cutting member. Here, the diameter of the developing sleeve 28 is, for example, 20 mm, the diameter of the photosensitive drum 1 is, for example, 80 mm, and a distance of the closest region between the developing sleeve 28 and the photosensitive drum 1 is, for example, about 300 μm. By this, the developer bristles carried on the developing sleeve 28 and conveyed to the developing position in a state where the length is regulated by the regulating blade 29 are brought into contact with the photosensitive drum 1, such that the electrostatic latent image on the photosensitive drum 1 is set to be able to be developed.

Such a developing sleeve 28 is made of a non-magnetic material such as aluminum or stainless steel, and a magnet roller 28*m*, which is a magnetic field forming portion, is installed therein in a non-rotating state. The magnet roller 28*m* has a developing pole S2 disposed to face the photosensitive drum 1 at the developing position. In addition, the magnet roller 28*m* has a magnetic pole S1 disposed to face the regulating blade 29, a magnetic pole N2 disposed between the magnetic poles S1 and S2, and magnetic poles N1 and N3 respectively arranged to face the developing chamber 23 and the agitating chamber 24.

Figure 2:
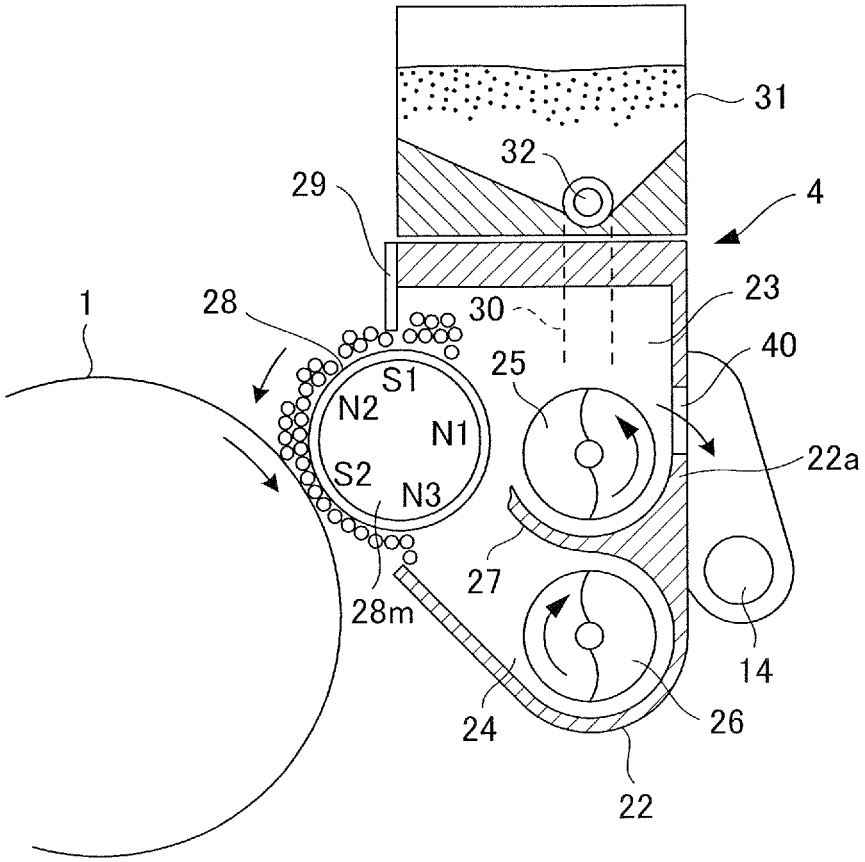
FIG. 2 is a sectional view of an outline configuration of a developing apparatus according to the first embodiment.

In this way, the developing sleeve 28 having the magnet roller 28*m* therein rotates in the direction of the arrow (counterclockwise) shown in FIG. 2 during the development, thereby conveying the developer while carrying the developer. Then, the developer of which the layer thickness is regulated by the cutting of the magnetic brush by the regulating blade 29 is conveyed to the developing area facing the photosensitive drum 1, and the latent image is developed by supplying the developer to the electrostatic latent image formed on the photosensitive drum 1.

At this time, in order to improve the developing efficiency, that is, in order to improve the application rate of toner to the latent image, a developing bias voltage in which a DC voltage and an AC voltage are superimposed is applied from a power source to the developing sleeve 28. In the embodiment, a DC voltage of −500 V, an AC voltage having a peak-to-peak voltage Vpp of 1400 V and a frequency f of 14 kHz are applied. However, the DC voltage value and the AC voltage waveform are not limited to this.

In general, in a two-component magnetic brush development method, when the AC voltage is applied, the development efficiency increases and the image becomes high quality, but conversely, fogging easily occurs. For this reason, fogging is prevented by providing a potential difference between the DC voltage applied to the developing sleeve 28 and the charged potential (that is, the white background potential) of the photosensitive drum 1.

The regulating blade 29 is made of a non-magnetic member formed of plate-like aluminum or the like extending along the rotational axis of the developing sleeve 28 and a magnetic member such as an iron material, and is disposed upstream of the photosensitive drum 1 in the rotating direction of the developing sleeve 28. Then, both the toner and the carrier of the developer pass between the distal end portion of the regulating blade 29 and the developing sleeve 28, and are sent to the developing position.

By adjusting the gap between the regulating blade 29 and the surface of the developing sleeve 28, the amount of bristles of the developer magnetic brush carried on the developing sleeve 28 is regulated and the amount of the developer conveyed to the developing position is adjusted. In the embodiment, the amount of developer coating per unit area on the developing sleeve 28 is regulated by the regulating blade 29, for example, to 30 mg/cm$^2$. The gap between the regulating blade 29 and the developing sleeve 28 is set to 200 to 1000 μm, and preferably 300 to 700 μm. In the embodiment, the gap is set to 400 μm.

Further, in the developing region facing the photosensitive drum 1, the developing sleeve 28 moves in the forward direction with the moving direction of the photosensitive drum 1, and moves in the peripheral speed ratio of, for example, 1.75 times with respect to the photosensitive drum 1. The peripheral speed ratio is set to 0 to 3.0 times, and may be any number as long as it is set between 0.5 and 2.0 times. The higher the moving velocity ratio, the higher the development efficiency. However, if the moving velocity ratio is too high, problems such as toner scattering and developer deterioration may occur, therefore it is preferable to set within the above range.

Next, a two-component developer containing toner and carrier used in the embodiment will be described. The toner has colored resin particles containing a binder resin, a colorant, and other additives as necessary, and colored particles to which an external additive such as colloidal silica fine powder is externally added. The toner is a negatively charged polyester-based resin, and the volume average particle size is preferably 4 μm or more and 10 μm or less, and more preferably 8 μm or less.

As the carrier, for example, surface-oxidized or non-oxidized iron, nickel, cobalt, manganese, chromium, rare earth, other metals, and their alloys, or oxide ferrite can be preferably used. The method for production of these magnetic particles is not particularly limited. The carrier has a weight average particle diameter of 20 to 60 μm, and preferably 30 to 50 μm, and a resistivity of $10^7$ Ωcm or more, and preferably $10^8$ Ωcm or more. In the embodiment, the carrier having a resistivity of $10^8$ Ωcm is used.

Replenishment of Developer

Next, a developer replenishing method according to the embodiment will be described with reference to FIGS. 2 and 3. A hopper 31 for accommodating a replenishing two-component developer in which toner and carrier are mixed is disposed on the upper part of the developing apparatus 4. The hopper 31 constituting the toner replenishing portion includes a screw-like conveyance member 32 at the lower part, and a first end of the conveyance member 32 extends to a position of a developer replenishing port 30 provided at a leading end portion of the developing apparatus 4.

The toner to be consumed by the image formation passes through the developer replenishing port 30 from the hopper 31 and is replenished to the developer container 22 by the rotational force of the conveyance member 32 and the gravity of the developer. In this way, the developer is replenished from the hopper 31 to the developing apparatus 4. The replenishment amount of the developer is determined by the number of rotations of the conveyance member 32. However, the number of rotations is determined by a toner replenishment amount control unit (not shown). As a method for controlling the toner replenishment amount, a method for optically or magnetically detecting the toner concentration of the two-component developer, and a method for developing a reference latent image on the photosensitive drum 1 and detecting the concentration of the toner image can be selected as appropriate.

Discharge of Developer

Next, a developer discharging method in the embodiment will be described with reference to FIGS. 2 and 3. A developer discharge port 40 constituting the developer discharge portion is provided on a side wall 22*a* of the developer container 22, and the deteriorated developer is discharged from the developer discharge port 40 along the arrow in FIG. 2. When the developer in the developing apparatus 4 increases in the developer replenishment process, the developer is discharged so as to overflow from the developer discharge port 40 according to the increased amount. That is, the developer discharge port 40 discharges the excessive developer accompanying the replenishment of the developer from the developer container 22. The discharged developer is conveyed to a collected developer storage (not shown) by a collecting screw 14 that is a conveyance member.

The position of the developer discharge port 40 is formed upstream of the position of the developer replenishing port 30 in the developer conveyance direction D1. This is to prevent the replenished new developer from being discharged immediately. In the embodiment, the developer discharge port 40 is provided on the side wall of the developing chamber 23 above the agitating chamber 24.

Relationship Between Developer Discharge Port and Conveyance Screw

Next, the relationship between the developer discharge port 40 and the first conveyance screw 25 will be described with reference to FIG. 4. As described above, the first conveyance screw 25 that is a conveyance member is disposed in the developing chamber 23 of the developer container 22. The first conveyance screw 25 has a blade 51 formed in a spiral shape on a rotation shaft 50 (on the rotation shaft), and rotates to convey the developer in the developer container along the rotation shaft 50. In the embodiment, for example, the blade 51 that is an agitating blade having a pitch of 30 mm and an outer diameter of 28 mm is provided evenly in the axial direction on the rotation shaft 50 having an axial diameter of 8 mm in the axial direction. The second conveyance screw 26 also has the same configuration. The developer discharge port 40 is provided on the side wall 22*a* (refer to FIG. 2) in the developing chamber 23, and the first conveyance screw 25 is disposed such that a part of the first conveyance screw 25 faces the developer discharge port 40.

The blade 51 of the first conveyance screw 25 rotates to direct from below to above in a vertical direction in an installation state of the image forming apparatus 100 at a facing part 56 facing the developer discharge port 40 (arrow direction in FIG. 4). That is, for example, as shown in FIG. 5, the first conveyance screw 25 rotates to direct from below to above in the facing part 56 of the blade 51 to the developer discharge port 40 when viewed from the developer conveyance direction D1. As shown in FIG. 4, the blade 51 is formed such that at least the facing part 56 of the first conveyance screw 25 to the developer discharge port 40 is directed downward as it goes to the downstream side in the developer conveyance direction D1 with respect to the rotation shaft 50. In the embodiment, the blade 51 is evenly formed over almost the entire area of the first conveyance screw 25 in the axial direction, and a part of the blade 51 facing the side wall 22*a* on which the developer discharge port 40 is formed, is formed to direct downward as it goes to the downstream side in the developer conveyance direction D1.

Phenomenon of Jumping-Up of Developer Due to Blade of Conveyance Screw

Next, a jumping-up phenomenon of the developer by the blade 51 will be described with reference to FIGS. 5 and 6. In addition to the excessive developer discharged so as to overflow from the developer discharge port 40 as described above, even a necessary developer which is not surplus is sometimes discharged due to jumping-up of the developer by the blade 51 of the first conveyance screw 25 facing the developer discharge port 40.

According to the observation of the inventor of the present application, such a jumping-up phenomenon caused by the blade 51 occurs in the following process. The developer in the developer container 22 is conveyed in a form in which the developer is pressed against the blade 51 while being accumulated on a surface 52 (refer to FIG. 4) facing the downstream side of the blade 51 with the rotation of the blade 51. At this time, the developer receives force also in the rotational direction other than the axial direction, accompanying the rotation of the blade 51. Therefore, the developer is conveyed in an oblique direction by the amount of force received in the rotational direction with respect to the developer conveyance direction D1. As a result, the developer is also jumped up in the direction of the side wall 22*a* (refer to FIG. 2) in the developing chamber 23, where the developer discharge port 40 is provided. In the facing part 56 where the first conveyance screw 25 faces the developer discharge port 40, the jumped-up developer is discharged from the developer discharge port 40, there is a possibility of causing unnecessary discharge.

This phenomenon becomes more remarkable, for example, when the blade 51 has a draft (tilt angle). Here, the draft is an inclination for smoothly pulling out the mold provided in the molded product. Without the draft, it becomes difficult to pull out the molded product from the mold, and when the draft is too small, a problem such as residual stress being applied to the molded product is likely to occur. For this reason, in the case of the molded product, the draft is inevitably set at a fixed angle or more. Since mold formation has a great advantage from the viewpoint of cost, the molded product may be used for parts such as screws. When forming a mold, the draft is basically provided. Therefore, also in the embodiment, the blade 51 has the draft.

Figure 5:
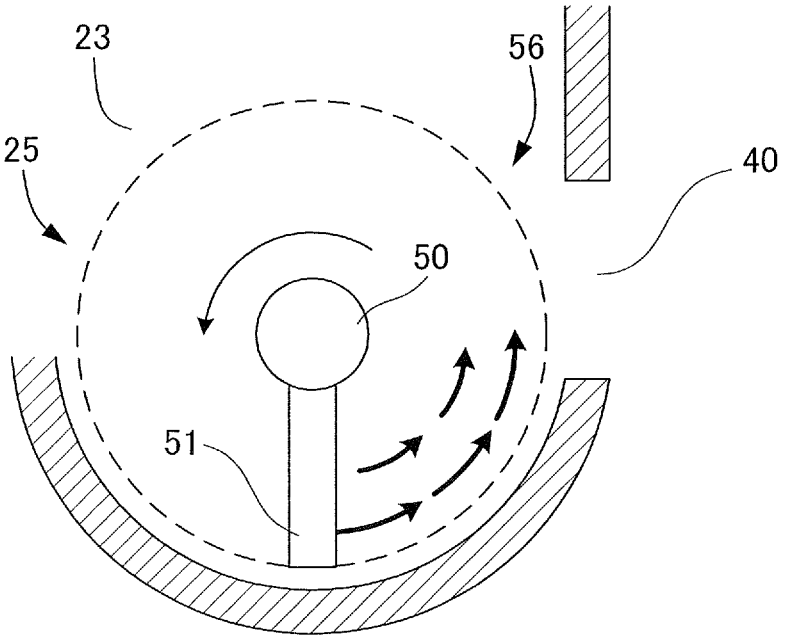
FIG. 5 is a schematic diagram showing a state where a screw having no draft in the developer container is cut in a direction orthogonal to a rotation shaft.
Figure 6:
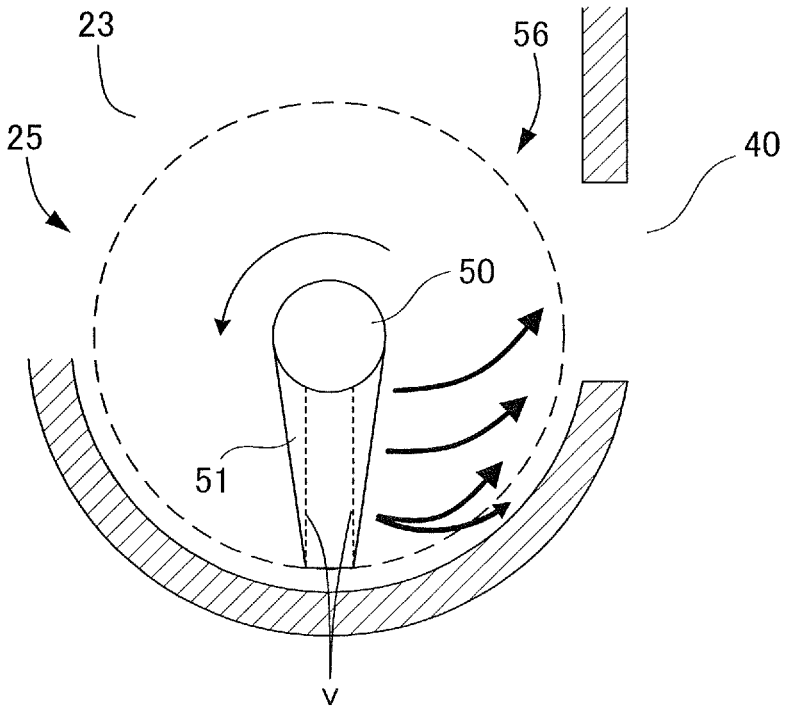
FIG. 6 is a schematic diagram showing a state where a screw having draft in the developer container is cut in the direction orthogonal to the rotation shaft.

FIGS. 5 and 6 show sectional views of cases where there are no drafts and cases where there are drafts, and show the directions of the force that the developer receives from the blade 51 by arrows, respectively. When the blade 51 does not have a draft, the developer receives force in the rotational direction (circumferential direction) of the blade 51 as indicated by the arrows in FIG. 5. On the other hand, as shown in FIG. 6, when the blade 51 has a draft, the blade 51 has an angle inclined with respect to the perpendicular line v of the rotation shaft 50. Therefore, as indicated by the arrows in the drawing, the developer receives force from the blade 51 not only in the rotational direction (circumferential direction) but also in an outward radial direction. For this reason, the developer that has received force by the rotation of the first conveyance screw 25 is more likely to jump off toward the outer periphery as compared with a case where there is no draft.

As a countermeasure against such a jumping-up phenomenon of the developer, it is conceivable to reduce the size of the developer discharge port. However, reducing the developer discharge port may affect the discharge of the excessive developer that should be originally discharged. That is, if the size of the developer discharge port is made too small to hinder the discharge of the excessive developer, the surface of the developer is not stabilized. For this reason, in order not to hinder the discharge of the excessive developer that should be originally discharged, the size of the developer discharge port is required to be a certain extent or larger. Therefore, only by making the size of the developer discharge port small, it is not sufficient for suppressing the developer discharge due to jumping-up. Therefore, in the embodiment, the developer discharge port 40 is configured as follows.

Developer Discharge Port

Figure 7:
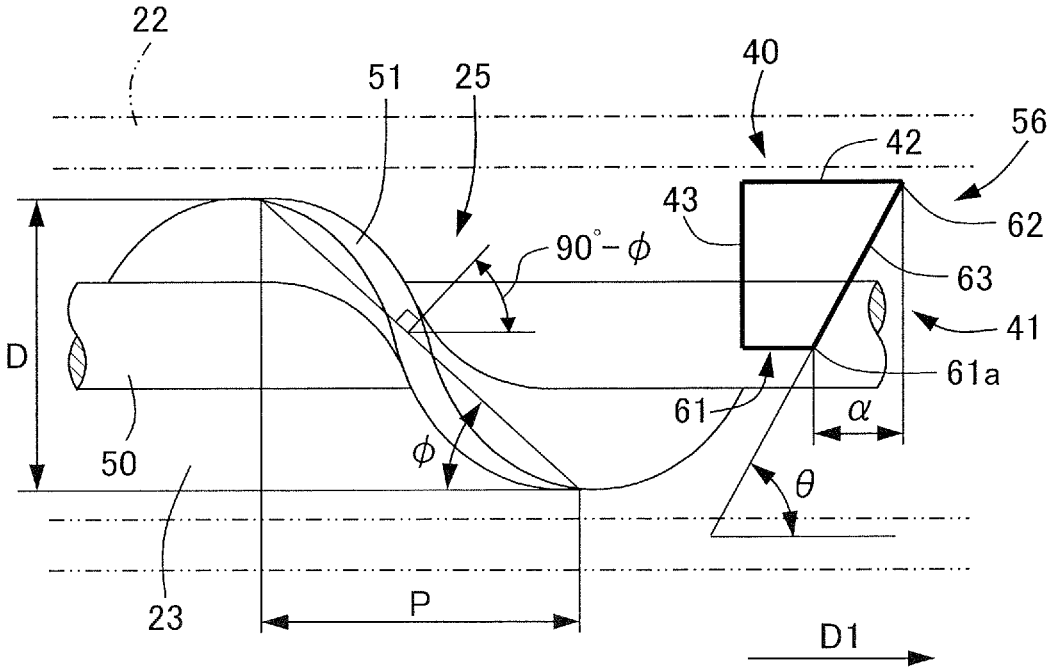
FIG. 7 is a schematic diagram showing a relationship between the developer discharge port and a blade according to the first embodiment.

The configuration of the developer discharge port 40 of the embodiment will be described with reference to FIGS. 7 to 11B. As shown in FIG. 7, the developer discharge port 40 has a lower end (lower edge) 41 and an upper end (upper edge) 42 in a vertical direction in an installation state of the developing apparatus 4. The lower end 41 has a bottom side (first portion) 61, an upper end portion (second portion) 62, and an inclined side 63. The bottom side 61 is positioned at the lowermost position in the vertical direction in the lower end 41 and is provided along the developer conveyance direction D1. The upper end portion 62 is positioned downstream of the bottom side 61 in the developer conveyance direction D1 and is positioned on the upper side of the bottom side 61 in the vertical direction. In the embodiment, the lower end 41 is continuous to the upper end 42 in the upper end portion 62. The inclined side 63 is a straight line that is inclined to direct upward as it goes to the downstream side in the developer conveyance direction D1 in a predetermined region a from a downstream end portion 61*a* of the bottom side 61 in the developer conveyance direction D1 to the upper end portion 62. Therefore, the developer discharge port 40 is formed in a trapezoidal shape with the upper end 42 having a long side and the bottom side 61 having a short side.

That is, the developer discharge port 40 has the upper end portion 62 which is a region positioned upward as the lower end 41 goes toward the downstream side in the developer conveyance direction D1 downstream of the bottom side 61 in the developer conveyance direction D1 where the height of the lower end 41 in the vertical direction is the lowest. Specifically, the lower end 41 in the vertical direction in the installation state is configured to be positioned upward as it goes to the downstream side in the developer conveyance direction D1, in the entire region of the predetermined region a from the downstream end portion 61*a* of the bottom side 61 to the upper end portion 62 in the developer conveyance direction D1. In particular, in the embodiment, the developer discharge port 40 is inclined in the predetermined region a such that the lower end 41 in the vertical direction is directed upward as it goes to the downstream side in the developer conveyance direction D1. Here, the blade 51 is formed such that the portion of the blade 51 facing the side wall 22*a* (refer to FIG. 2) where the developer discharge port 40 is formed is directed downward as it goes to the downstream side in the developer conveyance direction D1 with respect to the rotation shaft 50. Accordingly, the lower end 41 of the predetermined region a of the developer discharge port 40, that is, the inclined side 63 is inclined in a direction different from the shape of the portion of the blade 51 facing the side wall 22*a*.

As described above, in the embodiment, the blade 51 of the first conveyance screw 25 rotates to direct from below to above in the vertical direction in the installation state of the image forming apparatus 100 at the facing part 56 facing the developer discharge port 40. Here, since the behavior of the developer in the vicinity of the developer discharge port 40 is different between the case where the blade 51 is directed from below to above as in the embodiment, and the case where the blade 51 is directed from above to below opposite to the embodiment, at the facing part 56 facing the developer discharge port 40, the description will be made with reference to FIGS. 8A and 8B. In the facing part 56 facing the developer discharge port 40, FIG. 8A shows a case where the blade 51 is directed from above to below opposite to the embodiment, and FIG. 8B shows a case where the blades 51 is directed from below to above as in the embodiment.

Figure 8A:
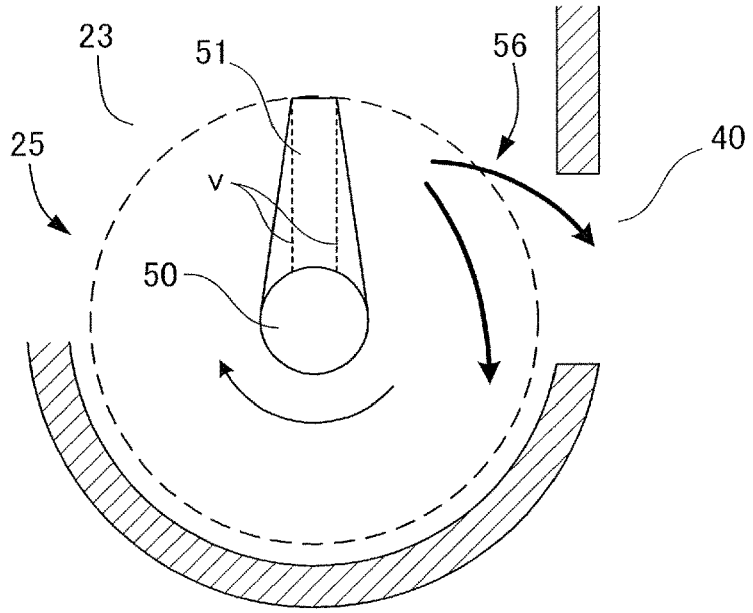
FIG. 8A is a schematic diagram showing a state of cutting a screw in a case where a blade rotates to direct from above to below in a facing part of a developer discharge port of a comparative example in a direction orthogonal to a rotation shaft.

As shown in FIG. 8A, when the blade 51 is directed from above to below at the facing part 56 facing the developer discharge port 40, a part of the developer jumped up by the blade 51 is discharged from the developer discharge port 40. Further, the developer that has not been discharged from the developer discharge port 40 does not return to the blade 51 and falls below the developing chamber 23 in which the first conveyance screw 25 is disposed. In this case, the developer that has not been discharged from the developer discharge port 40 is jumped up again by the blade 51 at the next rotation. Since the developer is conveyed from the upstream side in the developer conveyance direction D1 with the rotation of the first conveyance screw 25, the developer amount is returned to the original amount, and the change of the jumping-up amount of the developer by the blade 51 at the next rotation is small regardless of the discharge amount of the developer. Therefore, the jumping-up amount of the developer from the upstream to the downstream in the developer conveyance direction D1 of the developer discharge port 40 does not change much. As for the direction of improvement in this case, it is enough to shorten the time for the blade 51 to move in the region facing the developer discharge port 40.

Figure 8B:
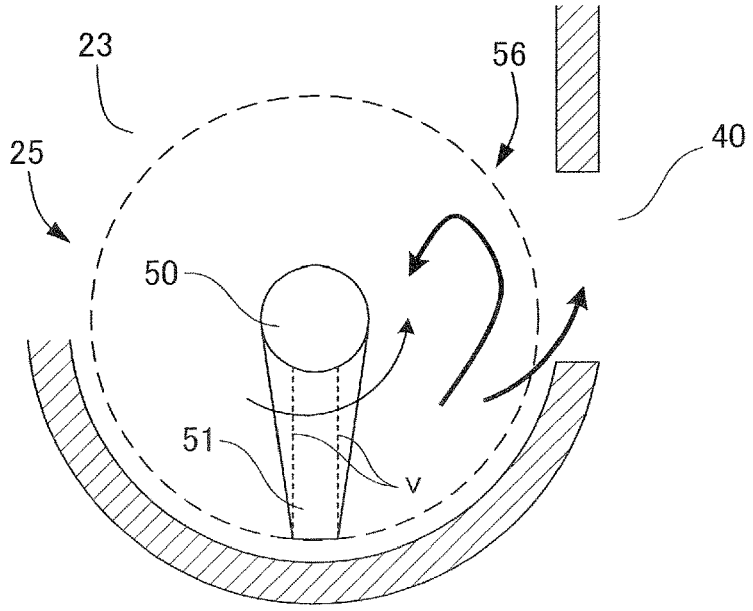
FIG. 8B is a schematic diagram showing a state of cutting the screw in a case where the blade rotates to direct from below to above in a facing part of the developer discharge port according to the first embodiment in the direction orthogonal to the rotation shaft.

On the other hand, as shown in FIG. 8B, the same as in the embodiment, when the blade 51 is directed from below to above at the facing part 56 facing the developer discharge port 40, a part of the developer jumped up by the blade 51 is discharged from the developer discharge port 40. The developer that has not been discharged from the developer discharge port 40 returns to the blade 51. In this case, since the developer is immediately jumped up again while being conveyed to the downstream side in the developer conveyance direction D1, when the developer is discharged on the upstream side in the developer conveyance direction D1 of the developer discharge port 40, the amount of the developer is reduced on the downstream side, and the jumping-up amount of the developer is reduced. Accordingly, the jumping-up amount of developer from the upstream side to the downstream side in the developer conveyance direction D1 of the developer discharge port 40 is gradually reduced when the developer is discharged. As for the direction of improvement in this case, it is considered that the amount of developer gradually decreases from the upstream side to the downstream side in the developer conveyance direction D1 of the developer discharge port 40 instead of simply shortening the time for the blade 51 to move in the region facing the developer discharge port 40. Accordingly, the developer discharge port 40 can more efficiently suppress the discharge of the developer due to jumping-up when the lower end 41 is inclined to direct upward as it goes to the downstream side in the developer conveyance direction D1.

Figure 9A:
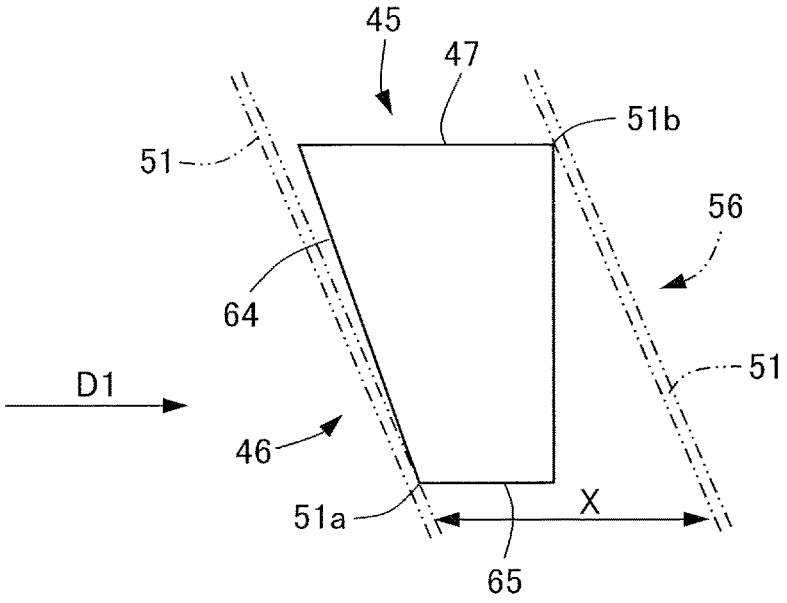
FIG. 9A is a schematic diagram showing a moving amount of a blade in a case where a lower end of a developer discharge port of a comparative example is inclined upward as it goes to an upstream side in a developer conveyance direction.
Figure 9B:
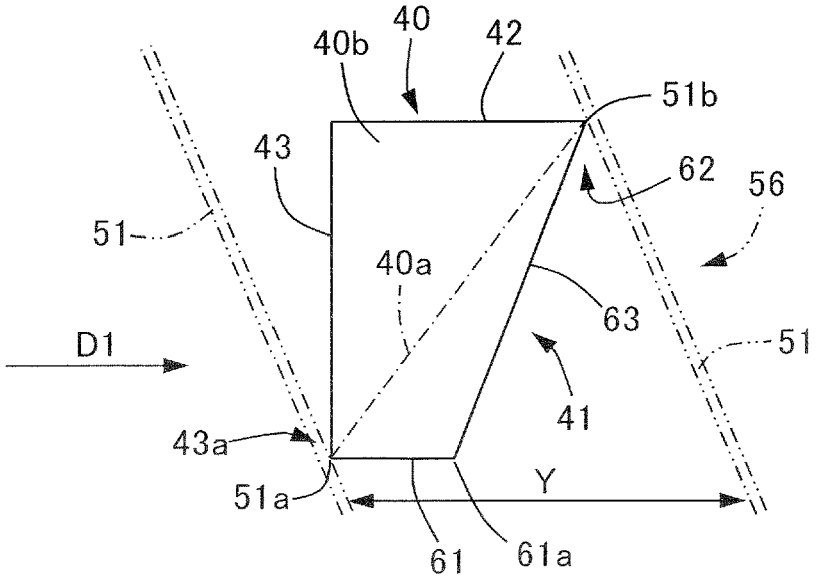
FIG. 9B is a schematic diagram showing a moving amount of a blade in a case where a lower end of the developer discharge port according to the first embodiment is inclined upward as it goes to a downstream side in a developer conveyance direction.

This point will be described with reference to FIGS. 9A and 9B. FIG. 9A shows a case where an inclined side 64 of a lower end 46 of a developer discharge port 45 of the comparative example is inclined upward as it goes to the upstream side in the developer conveyance direction D1. FIG. 9B shows the developer discharge port 40 of the embodiment. The developer discharge port 45 of the comparative example in FIG. 9A and the developer discharge port 40 of the embodiment in FIG. 9B have the same opening area. Further, in FIGS. 9A and 9B, it is assumed that the facing part 56 of the blade 51 is longer than the length of the developer discharge ports 45 and 40 in the vertical direction, and a case where the blade 51 is positioned at the upstream end portion and the downstream end portion in the developer conveyance directions D1 of the developer discharge ports 45 and 40 is schematically shown.

In the case of the comparative example shown in FIG. 9A, the facing part 56 of the blade 51 moves from an upstream end portion 51*a* of a bottom side 65 of the developer discharge port 45 to a downstream end portion 51*b* of an upper end 47. Here, the downstream end portion 51*b* coincides with the upper end portion 62. At this time, the moving distance of the facing part 56 of the blade 51 is X. On the other hand, in the case of the embodiment shown in FIG. 9B, the facing part 56 of the blade 51 moves from the upstream end portion 51*a* of the bottom side 61 to the downstream end portion 51*b* of the upper end 42 of the developer discharge port 40. At this time, the moving distance of the facing part 56 of the blade 51 is Y. Here, since the inclination direction of the inclined side 64 of the comparative example is the same as that of the blade 51, whereas the inclination direction of the inclined side 63 of the embodiment is different from that of the blade 51, the moving distance Y is larger than the moving distance X by the amount of the difference in the inclination directions of the respective inclined sides 63 and 64. Therefore, in the case of the embodiment shown in FIG. 9B, the time for the facing part 56 of the blade 51 facing the developer discharge port 40 to pass through the region facing the developer discharge port 40 is longer than that in the comparative example in FIG. 9A.

However, according to the examination of the inventor of the present application, although the passing time of the blade 51 is longer than that of the comparative example in FIG. 9A, discharge due to jumping-up of the developer can be suppressed in the embodiment of FIG. 9B. This is considered to be due to the following reason. Here, as described above, the case where the developer discharge port 40 is disposed at a position facing the facing part 56 where the blade 51 rotates to direct from below to above will be described. In this case, when the developer is discharged upstream of the developer discharge port 40 in the developer conveyance direction D1, the developer surface in the vicinity of the developer discharge port 40 is lowered as it goes to the downstream side in the developer conveyance direction D1. When the developer surface is lowered, the developer becomes difficult to be discharged, but in the case of the comparative example of FIG. 9A, since the inclined side 64 of the lower end 46 of the developer discharge port 45 becomes lower as it goes to the downstream side in the developer conveyance direction D1, the state of being easily discharged continues. For this reason, even when the developer surface is lowered and the developer is not required to be discharged, the developer is easily discharged and the discharge due to jumping-up cannot be suppressed. On the other hand, in the embodiment of FIG. 9B, since the inclined side 63 of the lower end 41 of the developer discharge port 40 is inclined upward on the downstream side in the developer conveyance direction D1 where the height of the developer surface is lowered, discharge by jumping-up of the developer is suppressed as it goes to the downstream side.

In the embodiment, the developer discharge port 40 has the upper end 42 in the vertical direction, and a side edge (upstream edge) 43 extending downward in the vertical direction from the upstream end of the upper end 42 in the developer conveyance direction D1. When a triangle formed by the upper end 42, the side edge 43, and a diagonal line 40*a* connecting the downstream end portion 51*b* of the upper end 42 in the developer conveyance direction D1 to a lower end 43*a* of the side edge 43 in the vertical direction is a reference triangle 40*b*, the developer discharge port 40 is formed such that an area of a part included inside the reference triangle 40*b* is larger than an area of a part which is not included inside the reference triangle 40*b*.

As an example, in the embodiment, as shown in FIG. 7, the upper end 42 and the bottom side 61 are provided along the developer conveyance direction D1, and the length of the upper end 42 in the vertical direction is provided longer than the bottom side 61 in the developer conveyance direction D1. The upper end portion 62 is the downstream end portion 51*b* (refer to FIG. 9B) of the upper end 42 in the developer conveyance direction D1. A portion between the downstream end portion 61*a* of the bottom side 61 and the upper end portion 62 in the developer conveyance direction D1 is the inclined side 63 that is inclined to direct upward as it goes to the downstream side in the developer conveyance direction D1. Further, the blade 51 is formed in a spiral shape inclined downward as it goes to the downstream side in the developer conveyance direction D1 at the facing part facing the developer discharge port 40.

As shown in FIG. 7, in the embodiment, the developer discharge port 40 is configured such that the length (width) of the upper end 42 in the vertical direction is longer than the length (width) of the bottom side 61 in the developer conveyance direction D1. By this, the width of the developer discharge port 40 is configured to expand from the bottom side 61 to the upper end 42. Thus, the developer is difficult to be discharged when the developer amount is proper and the developer surface is relatively low, but when the developer amount is increased and the developer surface is raised higher than the proper height, the developer is more easily discharged since the width of the developer discharge port 40 is gradually widened at the height of the developer surface. As a result, the developer surface in the developer container 22 is likely to return to the proper height. Such behavior is more effective in keeping the developer surface constant.

Further, in order to reduce the discharge due to the jumping-up by the blade 51, it is desirable that the developer discharge port 40 is made smaller, but, as described above, when the developer discharge port 40 is made small, the discharge of the developer to be originally discharged may be hindered. On the other hand, in the case of the embodiment, since the width of the developer discharge port 40 is increased as the developer increases, the discharge due to jumping-up can be suppressed without hindering the discharge of the excessive developer to be originally discharged.

Further, the predetermined region α shown in FIG. 7 preferably has a length of 50% or more of the maximum length of the developer discharge port 40 in the developer conveyance direction D1. This is to secure the opening area of the developer discharge port 40 while having the inclined side 63 in the predetermined region α. In other words, it is because the opening area of the developer discharge port 40 cannot be secured, and the discharging capacity of the excessive developer is lowered when the predetermined region α is less than 50% of the maximum length of the developer discharge port 40 in the developer conveyance direction D1. However, depending on the shape of the developer discharge port 40 and the desired developer discharge capacity, the predetermined range a may not satisfy the above conditions. For this reason, the predetermined region α is set such that the developer discharge due to jumping-up can be suppressed as described later, and an opening area capable of appropriately discharging the excessive developer can be secured. In order to more effectively suppress the discharge of the developer due to jumping-up, it is preferable that the width of the bottom side 61 of the developer discharge port 40 be less than or equal to the half the width of the upper end 42. For this reason, in the embodiment, the developer discharge port 40 has a vertical length (height) of 12 mm, whereas the width of the upper end 42 is 8 mm and the width of the bottom side 61 is 4 mm.

Further, as shown in FIG. 7, in the embodiment, the inclined side 63 of the predetermined region a of the developer discharge port 40 is inclined at a predetermined angle θ in the reverse direction with respect to the inclined angle φ of the blade 51 with respect to the rotation shaft 50 at the facing part 56 of the blade 51 facing the developer discharge port 40. The inclined angle φ of the blade 51 is represented by tan φ=D/P, where D is the outer diameter of the blade 51 positioned in the facing part 56 with respect to the developer discharge port 40 and P is the half pitch of the blade 51. The definition of the inclined angle φ of the blade 51 is not limited to the above definition, and may be other definitions. For example, as long as the shape of the facing part 56 of the blade 51 facing the developer discharge port 40 draws a sine curve, it may be defined by the angle of the tangent passing through the inflection point. Alternatively, it may be defined according to the positional relationship with the blade 51, for example, by the angle of the tangent passing through the position of the inclined side 63 facing the center position in the vertical direction in the facing part 56 of the blade 51 facing the developer discharge port 40.

Here, an angle orthogonal to the inclined angle φ with respect to the rotation shaft 50 in the facing part 56 of the blade 51 is represented by an orthogonal angle (90°-φ). Further, since tan φ=D/P, it is represented by tan (90°-φ)=P/D. In this case, the inclined angle θ of the inclined side 63 in the predetermined region α of the developer discharge port 40 is within a predetermined angle range with respect to the orthogonal angle (90°-φ), for example, within a range of ±30°, more preferably, within a range of ±20°. When the inclined angle θ is small, the developer discharge is easily performed by jumping-up on the downstream side in the developer conveyance direction D1, and when the inclined angle θ is large, the developer discharge port 40 becomes small, therefore, it can be properly set according to the setting conditions.

In the embodiment, the inclined angle θ of the inclined side 63 of the developer discharge port 40 is larger than the orthogonal angle (90°-φ) of the blade 51. According to the examination by the inventor of the present application, such a configuration further suppresses the jumping-up of the developer. This is considered to be due to the following reason. As in the embodiment, when the blade 51 rotates toward from below to above in the facing part 56 with respect to the developer discharge port 40, the jumping-up of the developer by the blade 51 is directed in a direction in which force that the developer receives from the blade 51 is substantially perpendicular to the blade 51. Accordingly, it is easy to fly toward a direction of the perpendicular line of the inclination of the blade 51, that is, in the orthogonal angle (90°-φ) of the blade 51. Therefore, by making the inclined angle θ of the inclined side 63 larger than the orthogonal angle (90°-φ) of the blade 51, the direction in which the developer is jumped up by the blade 51 is easily hidden from the opening region of the developer discharge port 40, and the discharge by the jumping-up of the developer can be more effectively suppressed.

Figure 10A:
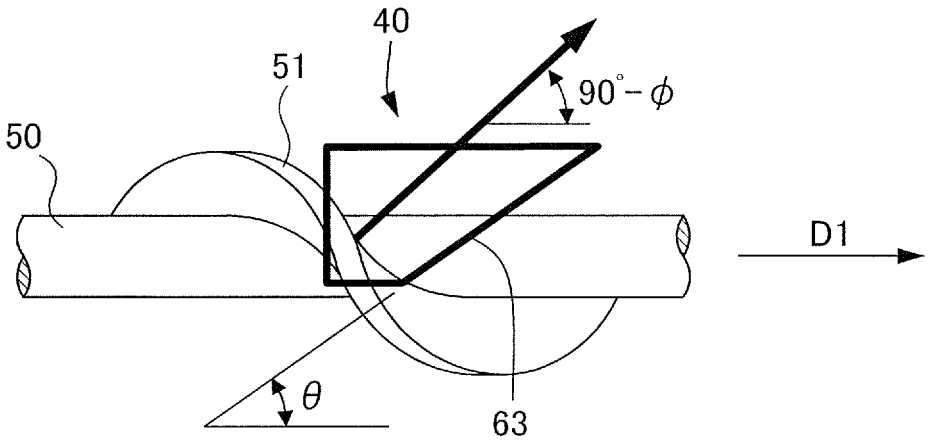
FIG. 10A is a schematic diagram showing a relationship between the developer discharge port and the blade according to the first embodiment, and shows a case where an inclined angle $\theta$ is smaller than an angle $(90°-\varphi)$.
Figure 10B:
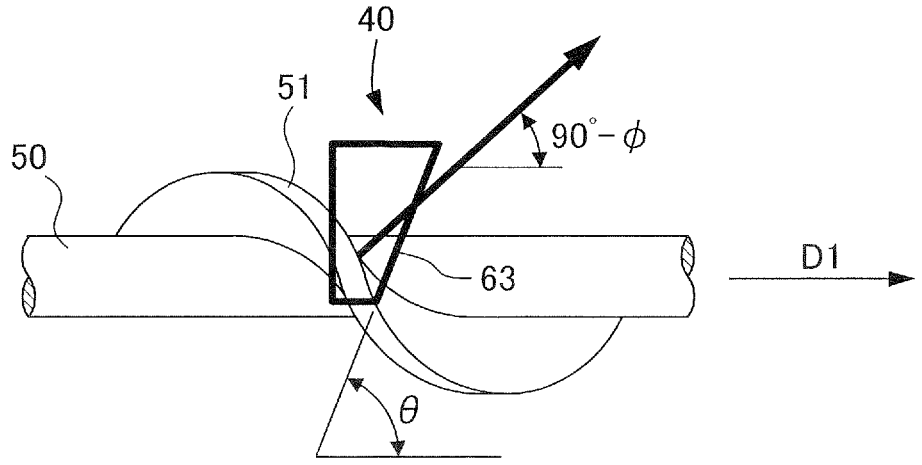
FIG. 10B is a schematic diagram showing a relationship between the developer discharge port and the blade according to the first embodiment, and shows a case where an inclined angle $\theta$ is greater than an angle $(90°-\varphi)$.

This point will be described with reference to FIGS. 10A and 10B. In FIGS. 10A and 10B, in order to make the explanation easy to understand, the blade 51 at the time when the rotating blade 51 reaches the vicinity of the facing position of the inclined side 63 of the developer discharge port 40 is shown. FIG. 10A shows a case where the inclined angle θ of the inclined side 63 of the developer discharge port 40 is smaller than the orthogonal angle (90°-φ) of the blade 51. In this case, even when the developer is jumped up in the vertical direction of the blade 51 indicated by the arrow in the drawing, the area in which the developer jumped is not completely hidden by the wall surface of the inclined side 63 of the developer discharge port 40. For this reason, the discharge due to the jumping-up by the blade 51 becomes relatively easy to occur. On the other hand, as shown in FIG. 10B, when the inclined angle θ of the inclined side 63 of the developer discharge port 40 is larger than the orthogonal angle (90°-φ) of the blade 51, the region where the developer is jumped up as shown by the arrow in the drawing is hidden by the wall surface of the inclined side 63 of the developer discharge port 40. As a result, the developer jumped up by the blade 51 hits the side wall 22*a* (refer to FIG. 2) downstream of the inclined side 63 of the developer discharge port 40 and does not jump out to the outside, thereby efficiently suppressing the discharge by the jumping-up of the developer due to the blade 51. For this reason, when the inclined angle θ of the inclined side 63 of the developer discharge port 40 is larger than the orthogonal angle (90°-φ) of the blade 51, the discharge due to jumping-up in the upper portion of the blade 51 can be efficiently suppressed.

Further, in the embodiment, as shown in FIG. 7, the bottom side 61 of the developer discharge port 40 does not change in height regardless of the position in the developer conveyance direction D1, and faces the upper side at the upstream end portion, and is formed to be continuous to the upper end 42 of the developer discharge port 40. That is, the side edge 43 on the upstream side of the developer discharge port 40 in the developer conveyance direction D1 is provided in the vertical direction without being inclined in the installation state of the developing apparatus 4.

However, the side edge 43 on the upstream side of the developer discharge port 40 in the developer conveyance direction D1 may be inclined with respect to the vertical direction. In this case, when the counterclockwise direction in FIG. 7 is set to be positive, it is preferable that the range of the inclined angle of the side edge 43 to the rotation shaft 50 is larger than an angle parallel to the inclined angle θ of the inclined side 63 in the predetermined region α and is smaller than an angle obtained by rotating the inclined angle by 180°. That is, when the inclined angle of the side edge 43 to the rotation shaft 50 is τ, it is preferable that θ<τ<(180°-θ). This is because, when τ is (180°-θ) or more, the proportion of the inclined region α with the inclined side 63 located at the upper part in the entire region decreases as it goes to the downstream side in the developer conveyance direction D1, such that the effect of suppressing the discharge of the developer due to jumping-up is reduced. Further, it is because, when τ is equal to or smaller than θ, the width of the developer discharge port 40 is configured to be the same or narrowed from the bottom side 61 to the upper end 42. In this configuration, as described above, it is difficult to obtain the effect that the surface of the developer in the developer container 22 easily returns to the surface of the developer having a proper height.

Next, the installation height of the lower end 41 of the developer discharge port 40, particularly the installation height of the bottom side 61 that is the lowermost end portion of the lower end 41 will be described. In the embodiment, the height of the bottom side 61 can be properly set, for example, in a range from a height slightly lower than the center line of the rotation shaft 50 (refer to FIG. 7) to a height (refer to FIG. 11B), for example, above an upper end 50*a* of the rotation shaft 50. By this, when the developer is increased, discharge is facilitated smoothly. Here, for example, as shown in FIG. 6, since the developer is easily jumped up in the direction of the developer discharge port 40 as the jumping-up by the blade 51 is lower than the center line of the rotation shaft 50, discharge by the jumping-up is easily caused. However, as in the embodiment, by the configuration in which the lower end 41 of the developer discharge port 40 is positioned upward as it goes to the downstream side in the developer conveyance direction D1, the smooth discharge can be promoted when the amount of the developer is increased and unnecessary discharge due to jumping-up can be suppressed.

In addition, there is a case where there is a high concern about discharging due to the jumping-up of the developer, such as when the driving speed of the developing apparatus 4 is high for adapting to the high-speed machine. In this case, it is preferable to dispose the lower end 41 of the developer discharge port 40 above the center line of the rotation shaft 50. By this, it becomes possible to more effectively suppress unnecessary discharge due to jumping-up.

Figure 11A:
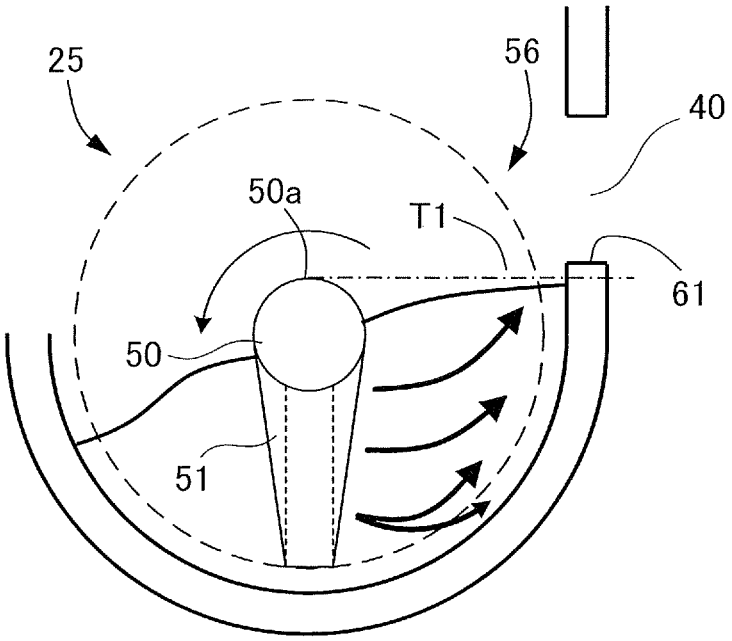
FIG. 11A is a schematic diagram showing a relationship between the developer discharge port and the blade according to the first embodiment, and shows a state where the screw is cut in the direction orthogonal to the rotation shaft.
Figure 11B:
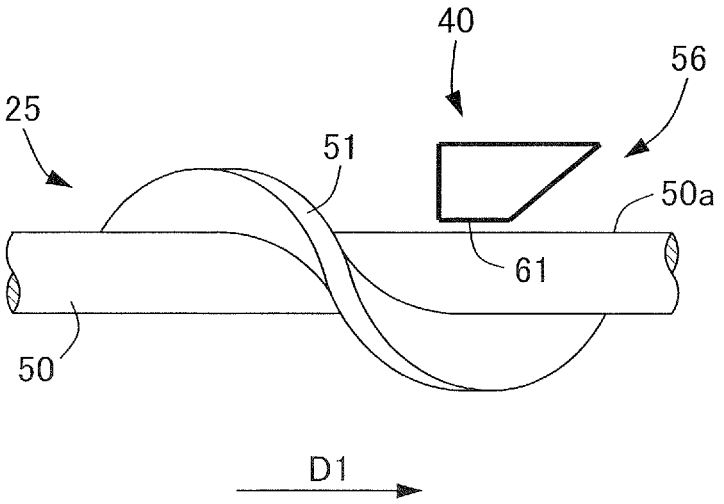
FIG. 11B is a schematic diagram showing a relationship between the developer discharge port and the blade according to the first embodiment, and shows a state when the screw is viewed from a side.

Here, the behavior of the developer when the driving speed of the developing apparatus 4 is high will be described with reference to FIGS. 11A and 11B. As shown in FIG. 11A, when the first conveyance screw 25 rotates at a high speed, a developer surface Ti is inclined such that the downstream side of the blade 51 in the rotational direction becomes high and the upstream side becomes low. Therefore, the developer surface Ti may be higher than the upper end 50*a* of the rotation shaft 50 at the facing part 56 of the blade 51 facing the developer discharge port 40. In this case, the bottom side 61 of the developer discharge port 40 is set higher than the upper end 50*a* of the rotation shaft 50 as shown in FIG. 11B. In other words, the developer discharge port 40 is located above the upper end 50*a* of the rotation shaft 50 in the vertical direction. By this, it becomes possible to more effectively suppress unnecessary discharge due to jumping-up.

The direction of jumping-up by the blade 51 of the first conveyance screw 25 changes with rotation, and the direction of jumping-up by the blade 51 begins to face an inside the developer container 22 from the developer discharge port 40 approximately above the center line of the rotation shaft 50. For this reason, it is preferable that the bottom side 61 of the developer discharge port 40 is positioned above the center line of the rotation shaft 50, particularly above the upper end 50*a* regardless of the state of the developer surface.

As described above, according to the developing apparatus 4 of the embodiment, the blade 51 of the first conveyance screw 25 rotates to direct from below to above in the vertical direction in the installation state at the facing part 56 facing the developer discharge port 40. The developer discharge port 40 has a lower end 41 in the vertical direction in the installation state, including a bottom side 61 positioned at the lowermost position in the vertical direction and an upper end portion 62 positioned downstream of the bottom side 61 in the developer conveyance direction D1 and positioned above the bottom side 61 in the vertical direction. By this, in the configuration in which the developer discharge port 40 is disposed at a position facing the part where the blade 51 of the first conveyance screw 25 rotates to direct from below to above, the discharge of the developer by jumping-up can be sufficiently suppressed.

Figure 12:
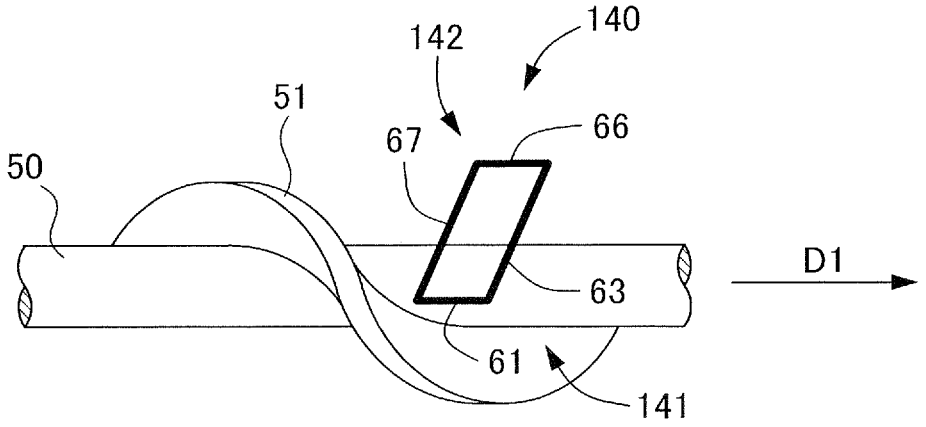
FIG. 12 is a schematic diagram showing a relationship between a developer discharge port and a blade according to a modification example of the first embodiment.

In the embodiment described above, the developer discharge port 40 has been described as having a trapezoidal shape with the upper end 42 having a long side and the bottom side 61 having a short side, for example, as shown in FIG. 7, but it is not limited to this. The developer discharge port 40 may have a lower end in the vertical direction, including a first part positioned at the lowermost position in the vertical direction and a second part positioned downstream of the first part in the developer conveyance direction D1 and positioned on the above the first part in the vertical direction. For this reason, for example, as shown in FIG. 12, when a developer discharge port 140 has a lower end 141 and an upper end 142 in the vertical direction, the lower end 141 and the upper end 142 may be set as follows. That is, the lower end 141 has the bottom side 61, the upper end portion 62, and the inclined side 63 the same as in the above-described embodiment. The upper end 142 has an upper side 66 that is positioned at the uppermost position in the vertical direction, and an inclined side 67 that is formed in parallel to the inclined side 63 from the upstream side of the upper side 66 in the developer conveyance direction D1. That is, the developer discharge port 140 may be formed in a parallelogram shape in which the upper side 66 and the bottom side 61 are parallel and the inclined side 63 and the inclined side 67 are parallel. Also, in this case, in the configuration in which the developer discharge port 140 is disposed at a position facing the part where the blade 51 of the first conveyance screw 25 rotates to direct from below to above, the discharge of the developer by jumping-up can be sufficiently suppressed.

Figure 13A:
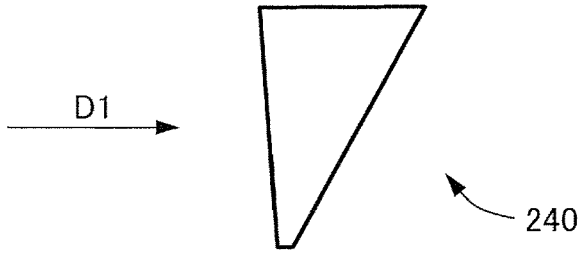
FIG. 13A is a schematic diagram showing various modification examples of the developer discharge port according to the first embodiment, and shows a case where the developer discharge port has a triangular shape.
Figure 13B:
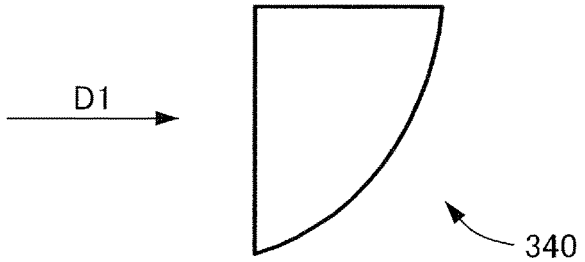
FIG. 13B is a schematic diagram showing various modification examples of the developer discharge port according to the first embodiment, and shows a case where the developer discharge port has a fan shape.
Figure 13C:
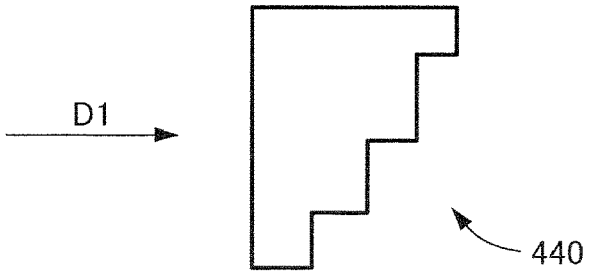
FIG. 13C is a schematic diagram showing various modification examples of the developer discharge port according to the first embodiment, and shows a case where a lower end of the developer discharge port is stepped.
Figure 13D:
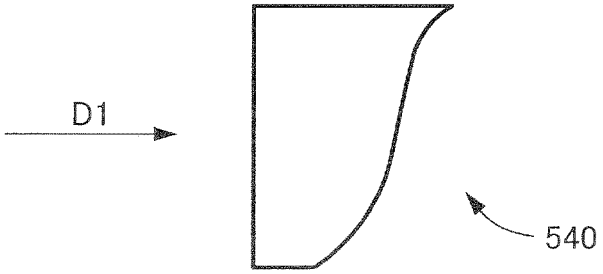
FIG. 13D is a schematic diagram showing various modification examples of the developer discharge port according to the first embodiment, and shows a case where a lower end of the developer discharge port is substantially S-shaped.

Further, the developer discharge port may be formed in various shapes as shown in FIGS. 13A to 13D, for example. For example, as shown in FIG. 13A, a developer discharge port 240 may be substantially triangular and inclined such that the side edge on the downstream side in the developer conveyance direction D1 may be positioned upward as it goes to the downstream side in the developer conveyance direction D1. In the developer discharge port 240, the side edge on the upstream side in the developer conveyance direction D1 is inclined so as to be positioned downward as it goes to the downstream side in the developer conveyance direction D1. Further, as shown in FIG. 13B, a developer discharge port 340 may be substantially fan-shaped and curved such that a lower end protrudes downward. Further, as shown in FIG. 13C, a lower end of a developer discharge port 440 may be stepped, or as shown in FIG. 13D, a lower end of a developer discharge port 540 may be substantially S-shaped of a sine curve.

Figure 14:
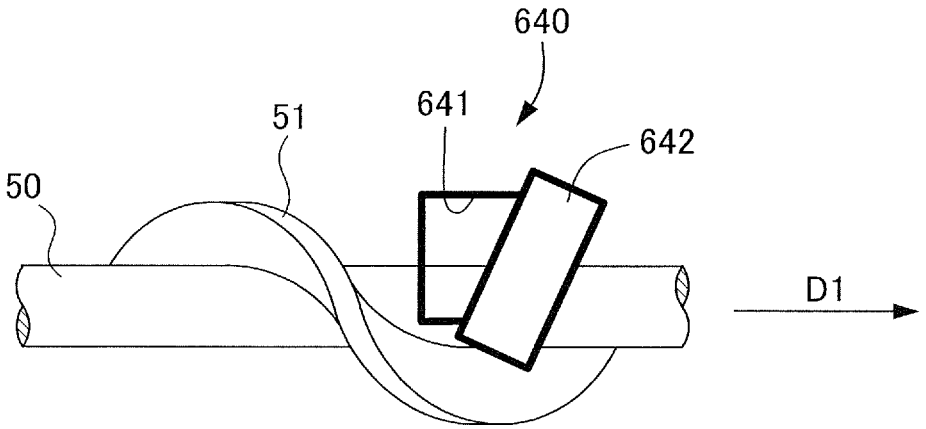
FIG. 14 is a schematic diagram showing a relationship between a developer discharge port and a blade according to another modification example of the first embodiment.

Further, as shown in FIG. 14, a developer discharge port 640 may be configured by using a plurality of members, for example, a sheet-like member 642 is disposed with respect to a rectangular opening portion 641. In this case, the side edge that covers the opening portion 641 with the member 642 becomes the inclined side of a lower end of the developer discharge port 640.

Further, in a region further downstream than a region in which the lower end of the developer discharge port is positioned upward as it goes to the downstream side in the developer conveyance direction D1, a part positioned downward the position of the lower end on the upstream side may be provided. However, the part positioned downward is positioned upward a position (the lowermost end position) where the height of the lower end in the vertical direction on the upstream of the region becomes the lowest. That is, if, in the downstream of the lowermost end position of the developer discharge port, it is configured to have the region positioned upward as it goes to downstream, in the downstream of the region, the position of the lower end may be formed to be slightly lowered at a position higher than the lowermost end position.

Second Embodiment

A second embodiment of the disclosure will be described with reference to FIGS. 15 and 16. In the case of the embodiment, first conveyance screws 125 and 225 as conveyance members are formed such that the conveyance force of the developer per unit length is lower than that in the range facing the developer discharge port 40 in a predetermined range C upstream of the developer discharge port 40 in the developer conveyance direction D1. First, in the case of the configuration shown in FIG. 15, the first conveyance screw 125 does not have the blade 51 in the predetermined range C upstream of the developer discharge port 40 in the developer conveyance direction D1.

Figure 3:
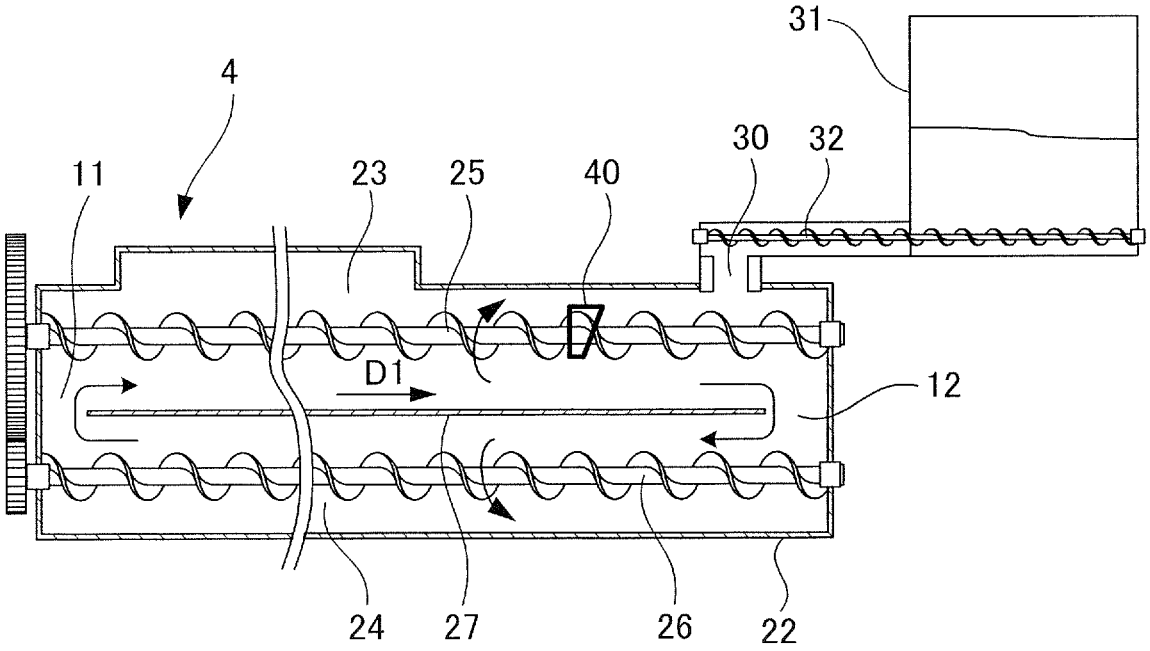
FIG. 3 is a sectional view of an outline configuration of the developing apparatus according to the first embodiment.
Figure 4:
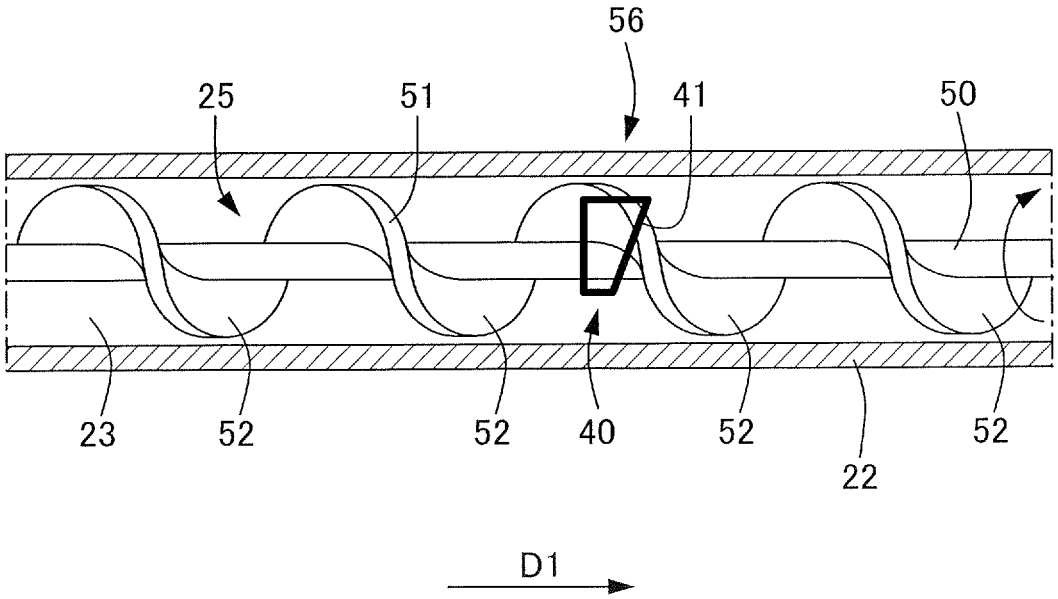
FIG. 4 is a sectional view of an outline configuration showing a relationship between a screw in a developer container of the developing apparatus and a developer discharge port according to the first embodiment.

As described in the first embodiment, as the blade 51 rotates, the developer in the developer container 22 is conveyed in such a way as to be pushed by the blade 51 while being collected on the surface 52 on the downstream side of the blade 51 (refer to FIGS. 3 and 4). The developer collected on the surface 52 of the blade 51 of the first conveyance screw 125 is easy to receive the force of the blade 51 and to cause unnecessary discharge by jumping-up. Therefore, if the amount of the developer that is collected on the surface 52 of the blade 51 of the first conveyance screw 125 can be reduced at least in the vicinity of the developer discharge port 40, unnecessary discharge due to jumping-up can be reduced.

Therefore, in the embodiment, the blade 51 of the first conveyance screw 125 is omitted in the predetermined range C on the upstream side of the developer discharge port 40 in the developer conveyance direction D1. By this, the developer collected on the surface 52 of the blade 51 while being conveyed in the developer container 22 is once reduced in conveyance force at a part where the blade 51 is omitted. Then, on the downstream side of the predetermined range C, it is started to collect again on the surface 52 of the blade 51. However, at the beginning of collection, since the amount of the developer that is collected on the surface 52 of the blade 51 is small, the amount of the developer that is jumped up by the blade 51 is also small. The downstream side of the predetermined range C where the developer starts to be collected is a region facing the developer discharge port 40. Therefore, in the region facing the developer discharge port 40, the amount of the developer that is jumped up by the blade 51 is reduced, such that the discharge of the developer due to the jumping up can be further suppressed.

In the embodiment, the omitted width of the blade 51 indicated by the predetermined range C is, for example, 8 mm. If the predetermined range C is 2 mm or more, a sufficient effect can be obtained. However, if the predetermined range C is too long, the first conveyance screw 125 does not have conveyance capacity in the range, and, since there is a possibility that the developer may stay, the predetermined range C is preferably set within 20 mm.

As for the position of the predetermined range C, the effect can be obtained to some extent by providing the position upstream of the developer discharge port 40 in the developer conveyance direction D1, but the effect is larger as it is closer to the developer discharge port 40. According to the examination of the inventor of the present application, by providing within one pitch (in the embodiment, for example, 30 mm) of the blade 51, the amount of the developer collected on the surface 52 of the blade 51 at the facing part 56 to the developer discharge port 40 can be reduced. In the embodiment, the blade 51 further upstream of an upstream part by 1 mm from the developer discharge port 40 is omitted by 8 mm.

Figure 15:
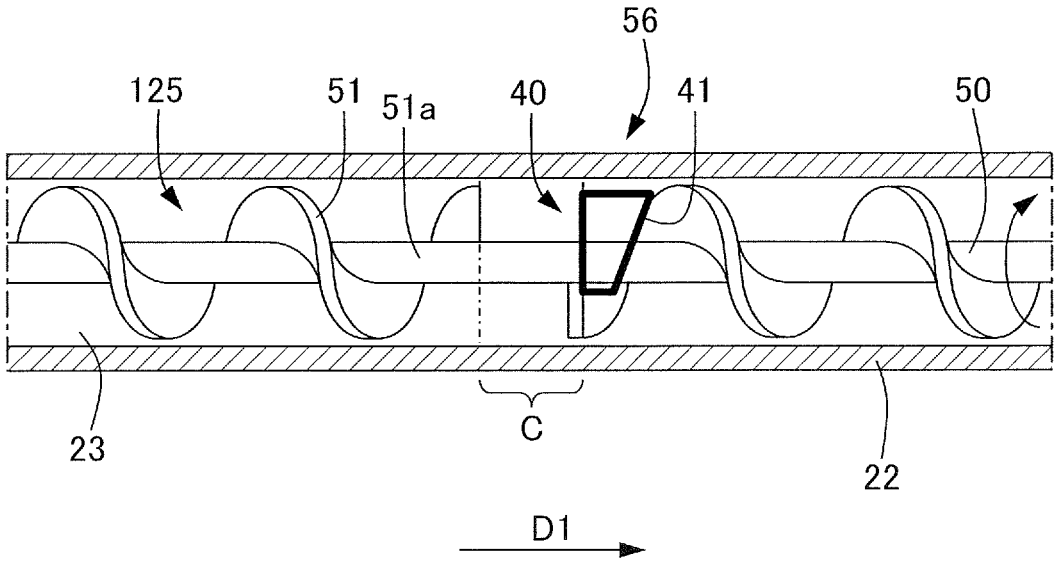
FIG. 15 is a schematic diagram showing a relationship between a developer discharge port and a blade of a developing apparatus according to a second embodiment.
Figure 16:
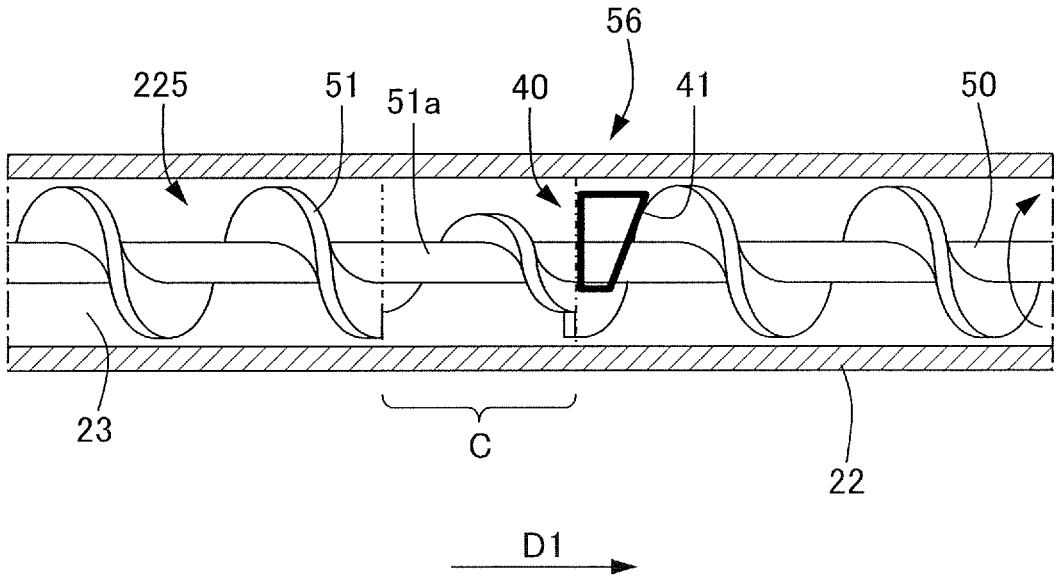
FIG. 16 is a schematic diagram showing a relationship between a developer discharge port and a blade of a developing apparatus according to a modification example of the second embodiment.

In the first conveyance screw 125 shown in FIG. 15, the blade 51 is omitted in the predetermined range C, but it is not limited to this. For example, as shown in FIG. 16, in the first conveyance screw 225, an outer diameter of the blade 51 in the predetermined range C upstream of the developer discharge port 40 in the developer conveyance direction D1 may be smaller than the outer diameter of the blade 51 in a range facing the developer discharge port 40. With such a configuration, the developer conveyance force in the predetermined range C is reduced, such that the same effect as in the configuration of FIG. 15 can be obtained. Other configurations and operations are the same as those of the first embodiment described above, and thus detailed description thereof is omitted.

As described above, according to the disclosure, in the configuration in which the developer discharge port is disposed at a position facing the portion where the blade of the screw rotates to direct from below to above, the discharge of the developer by jumping up can be sufficiently suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232719, filed Dec. 12, 2018, which is hereby incorporated by reference herein in its entirety.

What is claimed is:

1. A developing apparatus comprising:

a developer container configured to accommodate a developer including toner and carrier; and a conveyance screw comprising a helical blade spirally formed on a rotation shaft and configured to convey the developer in a developer conveyance direction along the rotation shaft, wherein the developer container has a developer discharge port at a position facing the helical blade to discharge the developer from the developer container, wherein the helical blade is configured to rotate to direct from below to above in a vertical direction at a position facing the developer discharge port, wherein the developer discharge port comprises a lower edge in the vertical direction, the lower edge comprising a region downstream in the developer conveyance direction from a lowermost position in the lower edge in the vertical direction, with the region in a position above the lowermost position in the vertical direction, wherein the region inclines upward as the lower edge goes downstream in the developer conveyance direction, and wherein, in a case where an angle (90°-φ) orthogonal to an inclined angle φ is represented by tan(90°-φ)=P/D, where the inclined angle φ is an angle with respect to the rotation shaft in a facing part to the developer discharge port of the helical blade, an outer diameter of the helical blade positioned in the facing part is D, and a half pitch of the helical blade positioned in the facing part is P, an inclined angle of the lower edge in the region is larger than the angle (90°-φ).

2. The developing apparatus according to claim 1, wherein the developer discharge port is positioned above an upper end of the rotation shaft in the vertical direction.

3. The developing apparatus according to claim 1, wherein the region has a length of 50% or more of a maximum length of the developer discharge port in the developer conveyance direction.

4. The developing apparatus according to claim 1, wherein the conveyance screw is formed such that a conveyance force of the developer per unit length is lower in a predetermined range upstream of the developer discharge port in the developer conveyance direction than in a range facing the developer discharge port.

5. The developing apparatus according to claim 4, wherein the predetermined range is 2 mm or more and 20 mm or less.

6. The developing apparatus according to claim 1, wherein the conveyance screw is formed such that the helical blade is not provided in a predetermined range upstream of the developer discharge port in the developer conveyance direction.

7. The developing apparatus according to claim 1, wherein the conveyance screw is formed such that an outer diameter of the helical blade in a predetermined range upstream of the developer discharge port in the developer conveyance direction is smaller than an outer diameter of the helical blade in a range facing the developer discharge port.

8. The developing apparatus according to claim 1, wherein an absolute value of a difference between the inclined angle of the lower edge in the region and the angle (90°-φ) is 20° or less.

9. The developing apparatus according to claim 1, wherein an absolute value of a difference between the inclined angle of the lower edge in the region and the angle (90°-φ) is 30° or less.

* * * * *